United States Patent [19]

Boyadjieff et al.

[11] 4,446,761

[45] May 8, 1984

[54] PIPE SPINNING TOOL

[75] Inventors: George I Boyadjieff; Frederick A. Monahan, both of Anaheim, Calif.

[73] Assignee: Varco International, Inc., Orange, Calif.

[21] Appl. No.: 257,105

[22] Filed: Apr. 24, 1981

[51] Int. Cl.[3] ..... B25B 17/00

[52] U.S. Cl. ..... 81/57.19; 81/57.2

[58] Field of Search ..... 81/57.2, 57.19; 294/88, 294/106; 173/164; 269/238, 22, 34, 242

[56] References Cited

U.S. PATENT DOCUMENTS

| | | | |
|---|---|---|---|
| 1,716,718 | 6/1929 | Castagna | 269/242 |
| 2,176,251 | 10/1939 | Duhan | 294/88 |
| 2,554,433 | 5/1951 | Warren | 294/88 |
| 3,322,456 | 5/1967 | Strakhal et al. | 294/88 |
| 3,892,148 | 7/1975 | Wiley | 81/57.2 |
| 4,207,783 | 6/1980 | Grakovac | 81/483 |
| 4,221,269 | 9/1980 | Hudson | 81/57.2 |

FOREIGN PATENT DOCUMENTS

| | | | |
|---|---|---|---|
| 662028 | 3/1929 | France | 81/58.1 |

*Primary Examiner*—James L. Jones, Jr.
*Attorney, Agent, or Firm*—William P. Green

[57] ABSTRACT

A well pipe spinner having two body parts carrying rollers adpated to engage a pipe at different locations about its periphery and grip and spin the pipe by rotation of one or more of the rollers, with the two body parts being mounted by pivotal connections for swinging movement about two spaced axes respectively to grip and release the pipe, and with an adjustable connection attaching the two pivotal connections together for relative lateral adjusting movement to shift their pivotal axes toward and away from one another for gripping different sizes of pipe.

15 Claims, 5 Drawing Figures

PIPE SPINNING TOOL

BACKGROUND OF THE INVENTION

This invention relates to improved power driven pipe spinners for rapidly rotating a pipe, such as a section of a drill string, to connect one pipe section to or disconnect it from another section.

In removing a string of drill pipe from a well, or lowering it back into the well, the numerous threaded connections in the string must be disconnected or connected as rapidly as possible in order to avoid unnecessary loss of rig time and minimize the cost of the overall drilling operation. To assist in such disconnection and connection of the threaded joints, power spinners have been devised which are capable of turning a pipe section rapidly in either direction relative to another section. A well known type of spinner currently in use includes a series of rollers adapted to engage a well pipe at different locations about its periphery in a relation gripping the pipe between the rollers and then driving it rotatively by powered rotation of one or more of the rollers. Some of the rollers are relatively movable between closed positions for contacting and gripping the pipe and open positions in which the rollers are spaced sufficiently to enable the tool to be moved between an active position about the pipe and a retracted position offset to a side of the pipe.

SUMMARY OF THE INVENTION

An object of the present invention is to provide an improved spinner of the above discussed general type which is simpler and cheaper than prior similar devices, is very rugged in construction and designed to prevent damage to the tool by contact with pipe or other equipment in use, and which is also easily and quickly adjustable to act on pipes falling within a wide range of sizes. Adjustment of the present tool to handle different size pipes does not require replacement of one size roller for another as has been necessary in some previously proposed units.

To achieve the desired capacity for use on different sizes of pipe, a spinner embodying the invention includes two roller carrying parts having portions receivable at different sides of the pipe and preferably formed as two essentially similar relatively movable body halves, with one of the parts being mounted by a pivotal connection for swinging movement about a predetermined axis between pipe gripping and pipe releasing positions, and with an adjustable connection attaching that pivotal connection to the other of the parts for relative lateral adjusting movement in a relation shifting the pivotal axis relative to that other part to grip and drive different sizes of pipe. Preferably, there are two pivotal connections mounting the two roller carrying parts respectively for pivotal movement about two different axes which are offset from one another, with the adjustable connection attaching the two pivotal connections together for relative lateral adjustment in a relation shifting their pivotal axes toward and away from one another to grip and drive the different sizes of pipe.

The two body parts are connected together for their relative swinging movement at a location intermediate opposite ends of the parts, with the rollers being carried at first ends of the parts. In the preferred arrangement, the two parts are actuated to gripping condition by force exerted by a pressure fluid operated unit desirably interposed between two closely proximate second ends of the body parts to actuate those ends relatively apart and thereby urge the roller carrying ends toward one another. The fluid pressure actuated unit may include a flexible bellows which is preferably interposed between the mentioned second ends of the body parts and is enclosed thereby in a manner protecting the bellows against damaging contact with other tools or equipment on the rig.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
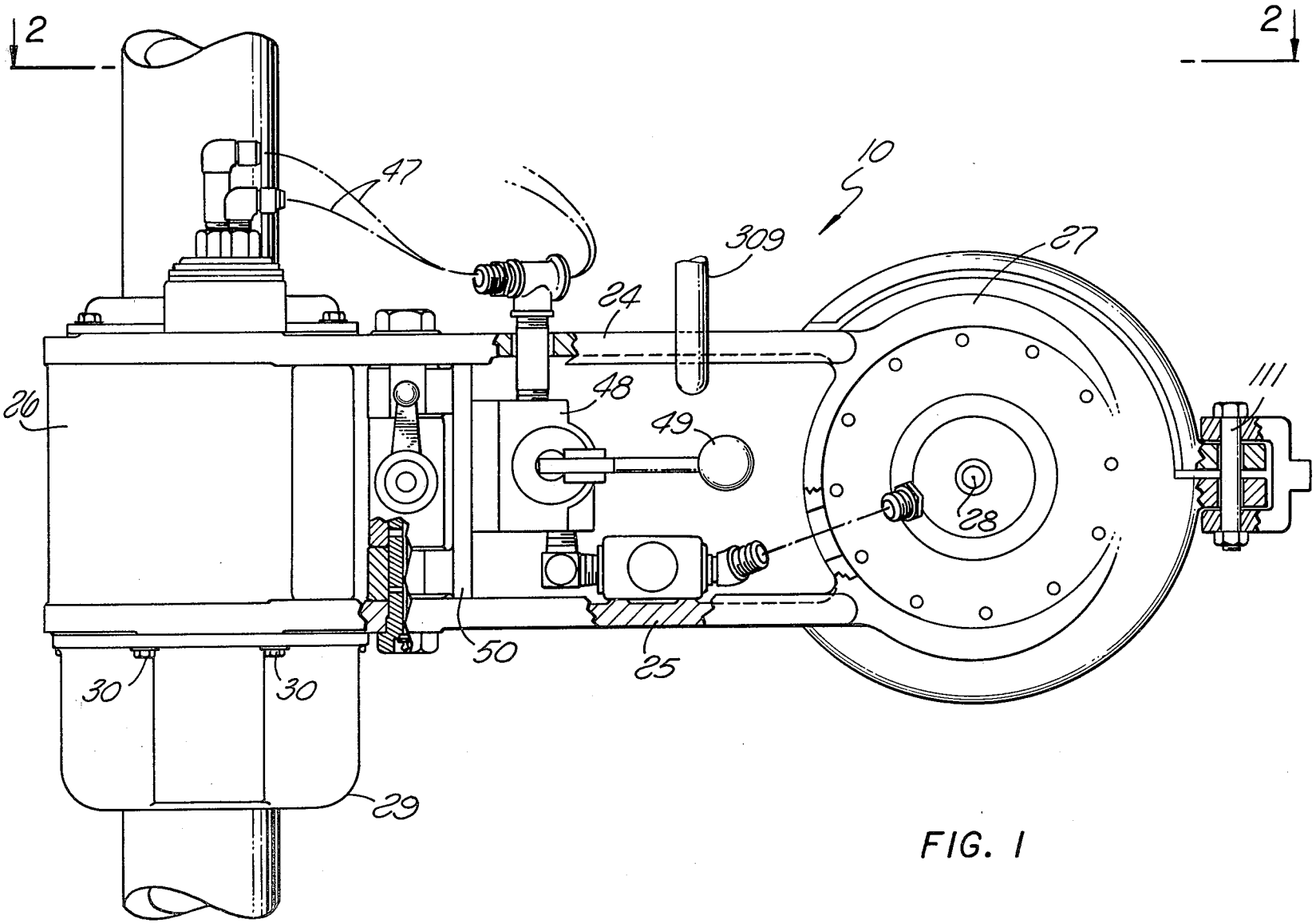
FIG. 1 is a side elevational view of a spinner constructed in accordance with the invention and illustrated in an active position about a well pipe.

The spinner 10 illustrated in the drawings includes two body halves or sections 11 and 12 (FIG. 2) which may be similar and mirror images of one another with respect to a central vertical plane 13 of the device. Each of the body halves carries a pair of rollers 14 at its left end as viewed in FIG. 2, with these rollers being driven by two separate motors 15. A pivotal connection 16 mounts body part 11 for swinging movement about a vertical axis 17, while a second pivotal connection 18 mounts the second body part 12 for swinging movement about a second vertical axis 19 parallel to but spaced from axis 17. An adjustable connection 20 is operable by rotation of a crank handle 21 to move the two pivotal connections toward and away from one another. A fluid pressure actuated unit 22 between the right ends of the two body parts 11 and 12 as viewed in FIG. 2 actuates those ends apart to urge rollers 14 into gripping engagement with well pipe 23.

As seen best in FIG. 1, each of the body parts 11 and 12 may be formed of a rigid metal casting having vertically spaced horizontal and parallel top and bottom walls 24 and 25 joined together at their left ends by a hollow portion 26 of the body section and their right ends by an essentially circular generally vertically extending portion 27 centered essentially about a horizontal axis 28. Beneath the hollow portion 26 of each body section 11 and 12, there may be carried a lower separately formed hollow part 29 (FIGS. 1 and 3), which may be appropriately secured to the portion 26 of the body part by bolts represented at 30 (FIG. 1).

Figure 3:
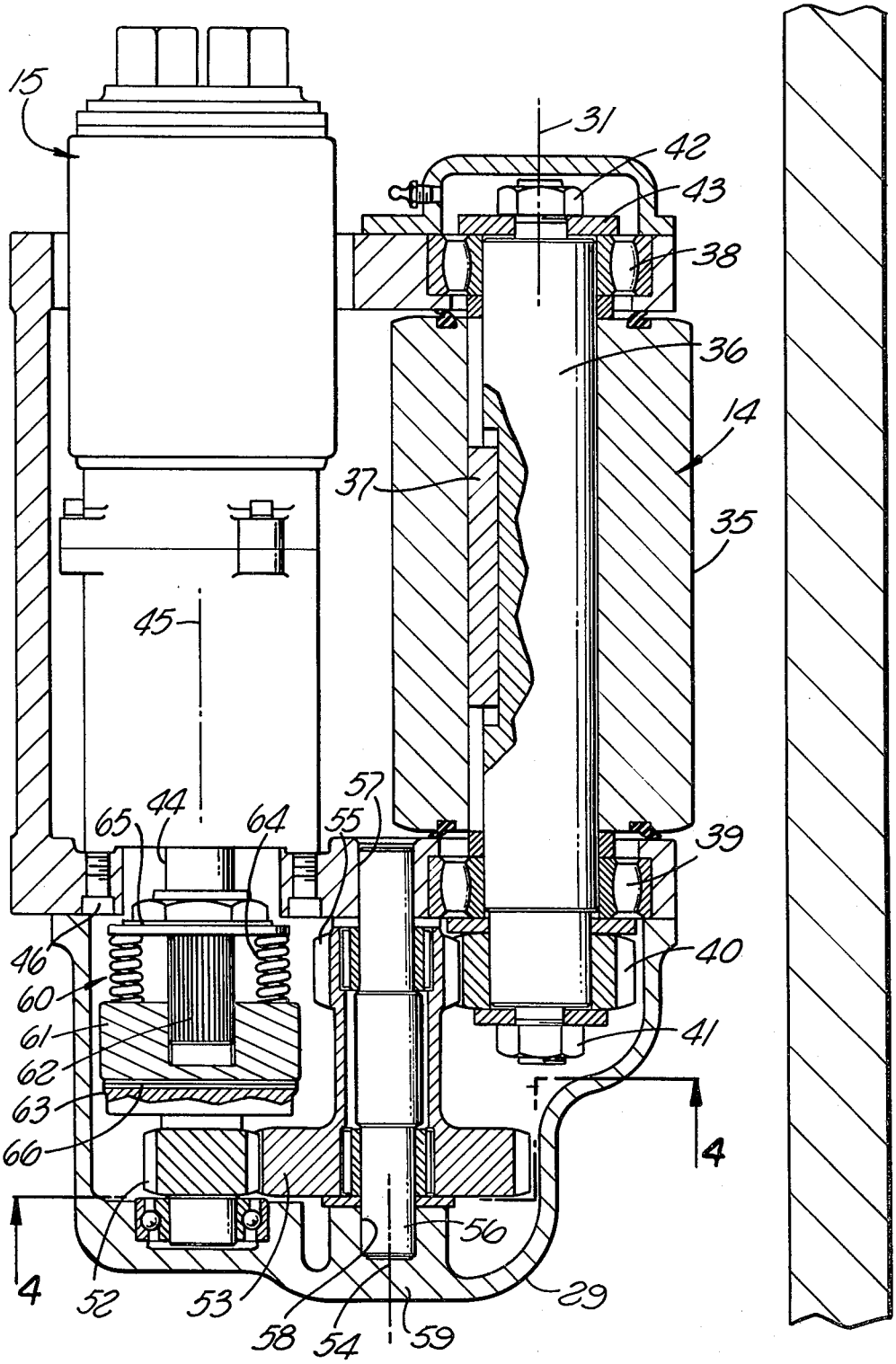
FIG. 3 is a vertical section taken primarily on line 3—3 of FIG. 2.

The four rollers 14 are mounted for rotation about four spaced parallel vertical axes 31, 32, 33 and 34, and have outer cylindrical surfaces 35 centered about those axes. As seen in FIG. 3, each of the rollers may be carried by a vertical shaft 36, and be retained against rotation relative to that shaft by a key 37 received in opposed grooves in the roller and shaft. The roller and its shaft are mounted for rotation relative to the associated body part 11 or 12 by a pair of bearings 38 and 39 carried in the top and bottom walls 24 and 25 of the body part at locations above and beneath the roller. The rollers are power driven about their individual axes by gears 40 attached rigidly to the lower ends of shafts 36 by nuts 41, and appropriately keyed to the shafts, with the shafts being retained against downward movement by nuts 42 clamping washers 43 against the inner races of the upper bearings.

Figure 2:
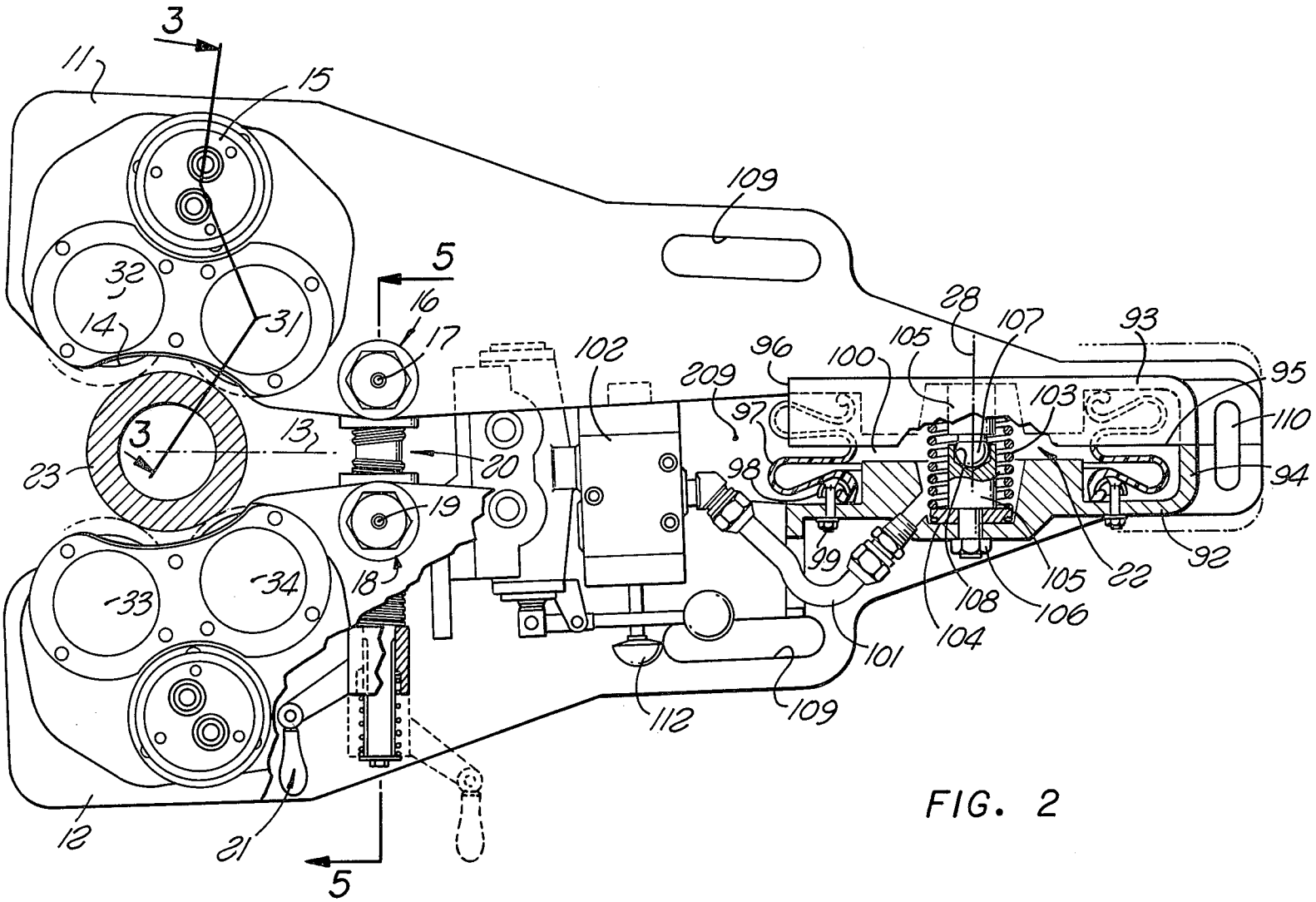
FIG. 2 is a plan view taken on line 2—2 of FIG. 1 and partially broken away to reveal the inner parts of the tool.

The two motors 15 are preferably pneumatically driven rotary motors each having its driven shaft 44 centered and rotatable about a vertical axis 45. The motors may be secured within hollow portions 26 of the two body halves 11 and 12 in appropriate manner, as by bolts or other fasteners 46 (FIG. 3) extending upwardly through a portion of bottom wall 25 of the body part and connected threadedly into the housing of the motor. These motors are capable of operation in either rotary direction, and are supplied with compressed air through two lines 47 under the control of a reversing valve 48 actuable by an operating handle 49. Valve 48 is appropriately secured to one of the body halves, as for instance to body section 12 by attachment of the valve to a vertical wall 50 extending between top and bottom walls 24 and 25 of that body section (FIGS. 1 and 2). Valve 48 and its handle 49 are thus enclosed vertically between the top and bottom walls 24 and 25 of body section 12, and are protected thereby against contact with other tools or equipment on the rig and against damage which might be caused by such contact. Handle 49 of the valve is actuable between a first position for admitting air to both of the motors through one of the lines 47 and discharging air from the motors through the other such line, a second position in which the connections are reversed to change the direction in which the motor turns, and an intermediate position in which the air to both lines is turned off to interrupt the drive to the motors.

Figure 4:
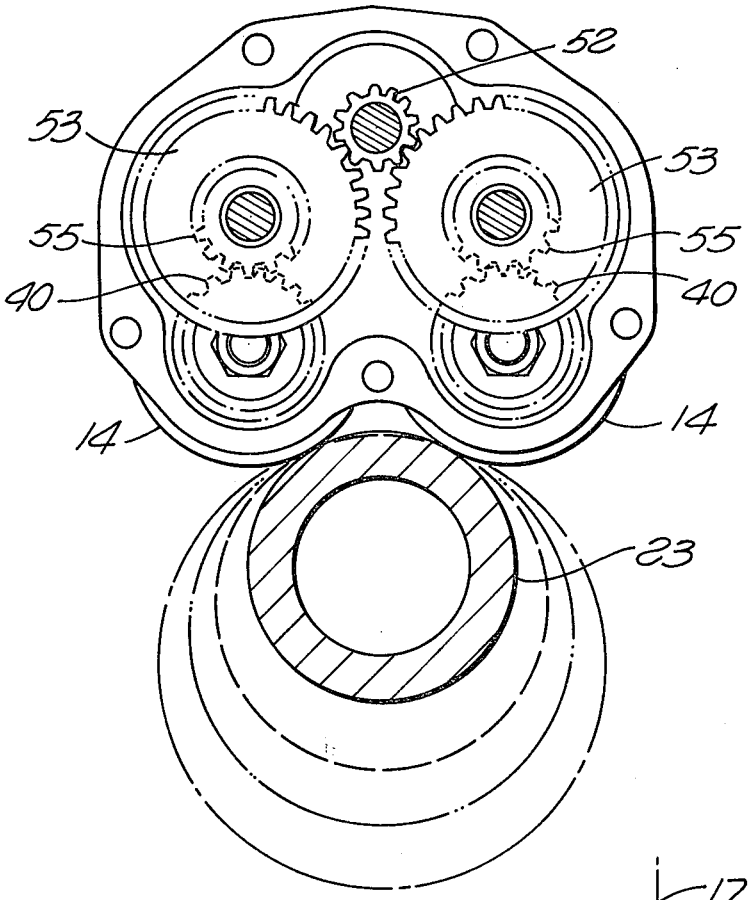
FIG. 4 is a horizontal section taken essentially on line 4—4 of FIG. 3.

Each motor 15 drives the two rollers 14 carried by the same body section 11 or 12 through two gear trains one of which is illustrated in FIG. 3. This gear train includes a first gear 52 turning about axis 45 and driven by the motor, a second gear 53 turning about a vertical axis 54, a third gear 55 rigidly connected to gear 53 to turn therewith about axis 54, and the previously mentioned gear 40 at the lower end of the corresponding roller 14. The two intermediate gears 53 and 55 are mounted rotatably about a vertical shaft 56, which is located at its upper end within an opening 57 in the wall 25 of the corresponding body part and at its lower end within a recess 58 in a bottom wall 59 of part 29. As seen in FIG. 4, the second of the two rollers 14 carried by a particular one of the body sections 11 or 12 is driven by a second pair of rigidly connected intermediate gears 53 and 55 driven by the same motor operated gear 52 as is seen in FIG. 3 and driving the roller through the gear 40 at its lower end.

In order to avoid damage to motors 15 when the well pipe 23 reaches the point at which its rotation is halted by engagement of stop shoulders on two sections being threadedly connected together, each of the motors 15 drives its corresponding gear 52 through a connection 60 (FIG. 3) which is capable of allowing some rotary motion of shaft 44 relative to gear 52 when the driving torque becomes excessive. This connection is typically illustrated as taking the form of a slip clutch, though it is to be understood that in lieu of such a clutch the connection may include a shock absorbing unit such as a coil spring or other resilient structure acting to transmit torque from motor shaft 44 to gear 52 but to allow slight relative movement of the parts to absorb the shock in the spring or other drive element. The slip clutch illustrated in FIG. 3 includes a first rotary clutch friction part 61 driven by motor shaft 44 through a spline connection 62 acting to transmit rotary motion from the shaft to part 61 while permitting limited axial movement of part 61 relative to the shaft. A second friction disc 63 is connected to gear 52 for rotation therewith, and the two friction elements 61 and 63 may be yieldingly urged axially against one another by coil springs 64 interposed between element 61 and a backing disc 65 carried by shaft 44. The friction faces 66 of the two clutch elements are thus pressed together and transmit rotation from shaft 44 to gear 52 until the rotation of the roller 14 is halted by completion of the thread make-up action, following which disc 61 can continue to rotate or slip relative to disc 63 and thus interrupt the drive and avoid damage to the motor or the gear trains or the rollers.

Figure 5:
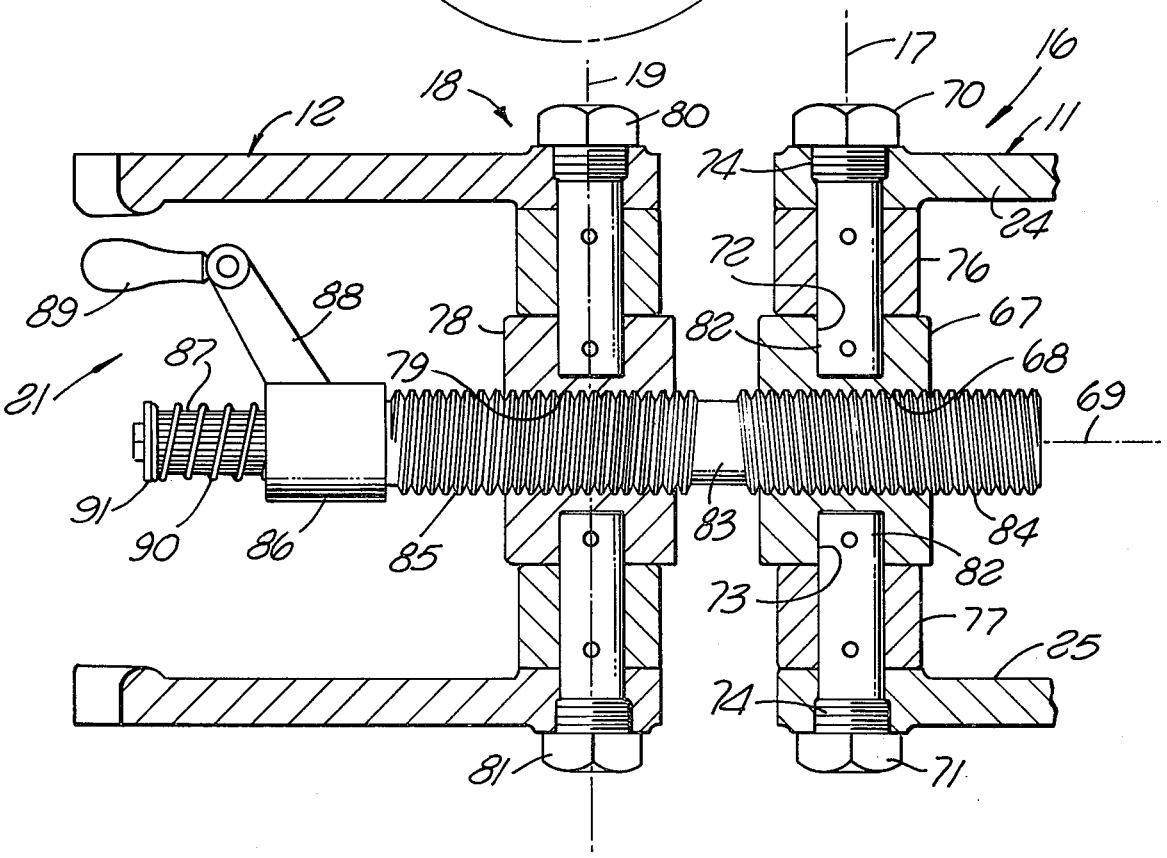
FIG. 5 is a vertical section taken on line 5—5 of FIG. 2.

As seen best in FIG. 5, the pivotal connection 16 which mounts body part 11 for pivotal movement about axis 17 includes a part 67 which may take the form of a block containing internal threads 68 centered about an axis 69. Pivot pins or screws 70 and 71 extend downwardly through a thickened portion 76 of top wall 24 of body part 11 and upwardly through a thickened portion 77 of bottom wall 25 of part 11 and along axis 17, and are retained in fixed position relative to part 11 by threaded engagement therewith at 74. Pins 70 and 71 have unthreaded portions 82 received within aligned bores 72 and 73 in the upper and lower ends of part 67 to enable the desired pivotal movement of body part 11 relative to block 67. The second pivotal connection 18 is constructed essentially the same as the above discussed connection 16, and includes a block or nut 78 having internal threads 79 and mounted by upper and lower pivot pins 80 and 81 for pivotal movement about axis 19 relative to body part 12.

The previously mentioned adjustable connection 20 for moving pivot connections 16 and 18 relatively toward and away from one another includes an adjusting screw 83 extending along and rotatable about axis 69 and having a first set of external threads 84 engaging internal threads 68 in the block or nut 67, and a second set of external threads 85 engaging internal threads 79 in the block or nut 78. Threads 68 and 84 are right hand threads, while threads 79 and 85 are left hand threads, so that rotation of screw 83 in one direction shifts the nuts and their axes 17 and 19 relatively toward one another, while rotation of the screw in the opposite direction shifts the nuts and their axes relatively away from one another. The pitch or rate of advancement of the right hand threads is preferably the same as the pitch or rate of advancement of the left hand threads.

Handle 21 for turning the lead screw 83 functions as a crank, having a sleeve portion 86 received about an unthreaded end portion 87 of the screw element, with an arm 88 projecting generally radially outwardly from sleeve 86 and carrying the handle proper 89. Sleeve 86 is internally splined, and portion 87 of the screw element is externally splined, to enable axial movement of sleeve 86 and the carried handle between the full line inactive position of FIG. 2 and the broken line active adjusting position thereof. A coil spring 90 extending about the unthreaded splined portion 87 of the screw element and bearing in opposite directions against sleeve 86 and a washer 91 carried at the outer end of the screw yieldingly urges the sleeve and handle axially inwardly to the retracted or inactive position in which the handle is received entirely within the enclosure formed vertically between the top and bottom walls 24 and 25 of body part 12, to thus protect the handle against damaging contact with other parts. When the device is to be adjusted, the handle is pulled outwardly against the tendency of spring 90 and to the broken line position of FIG. 2, so that rotation of the handle about axis 69 will act to shift the pivotal connections toward or away from one another.

The circular end portions 27 at the right ends of the two body parts 11 and 12 as viewed in FIGS. 1 and 2 are centered essentially about the common horizontal axis 28, and have the sectional configuration illustrated in FIG. 2. As will be apparent from that figure, these two generally circular parts 27 have spaced vertical outer walls 92 and 93 which in the FIG. 2 condition are parallel to one another and which have peripheral flanges 94 extending axially toward one another and meeting one another in a central vertical plane 95. The flanges 94 extend arcuately or cylindrically about axis 28 except at the forward side 96 where the flanges 94 are interrupted as will be understood from FIG. 2.

An annular flexible bellows element 97 extends between the walls 92 and 93 of the two essentially circular portions 27 of the body parts, being clamped annularly to and against these walls in fluid tight relation by annular clamping parts 98 retained by circularly spaced clamping screws 99. A sealed chamber 100 is thus formed within the bellows and between portions 27 of the two body parts, to which compressed air may be supplied through a line 101 leading from a manually actuated control valve 102. A spring 103 yieldingly urges the outer end portions 27 of the two body parts relatively toward one another and to the FIG. 2 full line positions. This spring 103 has its opposite ends clamped against the walls 92 of the two portions 27 respectively by two discs or rings 104 clamped between two elements 105 and walls 92, to maintain spring 103 at all times under tension in a manner pulling portions 27 toward one another. Elements 105 have threaded shanks which project through openings in walls 92 in sealed relation and are retained by nuts 106 to secure the parts together. Portions 27 of the two body parts are located relative to one another by reception of a spherical lug or projection 107 formed on one of the parts 105 within a mating recess 108 formed in the other part 105. As will be understood, when the right end portions of body parts 11 and 12 move relatively apart, ball 107 is free to move slightly out of its mating recess 108. Valve 102 is operable to supply compressed air to chamber 100 or to release the pressure from that chamber, and like valve 48 is located vertically between the upper and lower walls 24 and 25 or body section 12 to be protected by those walls and shielded against contact with other pieces of equipment on the rig.

The two body sections 11 and 12 have openings 109 extending along their outer edges at opposite sides of and in lateral alignment with the center of gravity 209 of the overall tool. Suspending hooks or lines 309 can thus be connected to the device at openings or slits 109, and when so suspended the tool will be balanced in a manner maintaining its essentially horizontal position of FIG. 1 while the tool is in use. The outer ends of parts 11 and 12 may contain vertically aligned slits 110 (FIGS. 1 and 2), by which a connector 111 may be attached to the ends of the parts for connection to a back-up line acting to retain the spinner against rotation about the well axis in use.

When it is desired to spin the pipe 23, the tool 10 is suspended in the manner illustrated in FIG. 1, and with the body parts 11 and their carried rollers in the open condition illustrated in full lines in FIG. 2, is moved horizontally to the position of FIGS. 1 and 2 in which the rollers are received about the well pipe. The operator then actuates handle 112 of valve 102, to admit compressed air to chamber 100 within the interior of bellows 97, to thereby force the circular portions 27 of the body parts relatively away from one another, pivoting body parts 11 and 12 about axes 17 and 19 relative to their carrying blocks or nuts 67 and 78, to thereby move the left ends of the body parts 11 and 12 as viewed in FIG. 2 relatively toward one another and thus shift rollers 14 to their broken line positions of engagement with the pipe. With the rollers thus clamped tightly against the pipe, the operator actuates handle 49 of valve 48 to admit compressed air to motors 15 in a direction causing those motors to drive rollers 14 in a manner turning the pipe in the desired direction to either connect or disconnect a threaded joint as may be intended. If this rotation is halted by engagement of shoulders on two sections being connected together, the slip clutches 60 will automatically halt the transmission of power from the motors to the gear trains and rollers, and by the slipping action prevent damage to the gears, motors and rollers. After the spinning operation has been completed, the operator actuates valve 49 to cut off the supply of air to the rotary motors, and actuates valve 102 to release the pressure within chamber 100 within the bellows, allowing the body parts to swing back to their full line positions of FIG. 2 under the influence of spring 103, releasing the rollers from engagement with the pipe and permitting the tool to be moved away from its position about the pipe.

If rotation of the pipe in the opposite direction is desired, the operation is the same as discussed except that valve 48 is actuated in the opposite direction to turn the motor and the pipe reversely.

When the tool is to be used for spinning a larger size of pipe, the operator pulls handle 21 axially outwardly relative to screw 83 and to the broken line position of FIG. 2, and then rotates the screw to shift nut elements 67 and 78 and the other parts of pivotal connections 16 and 18 relatively apart, so that their pivotal axes 17 and 19 are farther apart than illustrated in FIG. 2, to thereby move rollers 14 farther apart than in that figure. As a result, when compressed air is supplied to chamber 100 to pivot the body parts 11 and 12 about their axes 17 and 19, the rollers will move inwardly toward one another to properly engage the increased diameter pipe, and drive that pipe rotatively when the motors are again energized. If a pipe smaller than that shown in FIG. 2 is to be utilized, the adjusting screw is turned in the opposite direction to shift axes 17 and 19 closer together. Thus, the tool can effectively engage and drive pipes within a wide range of sizes.

While a certain specific embodiment of the present invention has been disclosed as typical, the invention is of course not limited to this particular form, but rather is applicable broadly to all such variations as fall within the scope of the appended claims.

We claim:

1. A pipe spinner comprising:

a plurality of rollers engageable with a pipe at different locations about its periphery and adapted to grip and spin the pipe;

two body parts having portions receivable at different sides respectively of said pipe and each carrying at least one of said rollers;

two structures movably mounting said body parts respectively;

to pivotal connections attaching said body parts to said structures respectively for pivotal movement of the body parts relative to said structures about two spaced axes between a closed position in which the rollers grip and drive a pipe and an open position releasing the pipe;

a rotatable adjusting element having a right hand thread and a left hand thread;

right hand and left hand threads on said two structures respectively engaging said right hand and left hand threads of said adjusting element in a relation moving said structures and the axes of said pivotal connections toward and away from one another in response to rotation of said adjusting element, to grip and drive different sizes of pipe;

powered means for swinging said body parts about said pivotal axes relative to said structures and between open and closed positions in differently spaced conditions of said axes; and motor means operable to drive at least one of said rollers rotatively, and thereby turn the pipe, in any of a plurality of different rotary settings of said adjusting element in which said pivotal axes of the body parts are spaced different distances apart;

said powered means including a unit which is operable by pressurized fluid and which, in any of a plurality of differently spaced conditions of said axes, acts to urge two actuating portions of said body parts relatively apart and thereby pivot said first mentioned portions of the body parts and their carried rollers toward one another and against the pipe.

2. A pipe spinner as recited in claim 1, in which said adjusting element is a screw having said right hand and left hand threads thereof formed as axially aligned external threads, said two structures being nut elements having said threads thereof formed internally.

3. A pipe spinner as recited in claim 1, including a handle for manually rotating said adjusting element.

4. A pipe spinner as recited in claim 1, including a handle for rotating said adjusting element and mounted for movement axially relative thereto between an outer active rotating position and an inner retracted position.

5. A pipe spinner as recited in claim 1, in which there are two of said rollers carried by each of said body parts at locations offset from said pivotal axes, said motor means including two motors carried by said body parts respectively and each driving two rollers carried by the same body part.

6. A pipe spinner as recited in claim 1, including a manually actuated handle for turning said adjusting element and mounted for movement relative to the adjusting element between an outer active turning position projecting laterally beyond one of said body parts and an inactive position retracted inwardly relative to said one body part.

7. A pipe spinner as recited in claim 1, including a manually actuated handle for turning said adjusting element and mounted for movement relative to the adjusting element between an outer active turning position projecting latterally beyond one of said body parts and an inactive position retracted essentially into a recess in one of said body parts.

8. A pipe spinner comprising:

a plurality of rollers engageable with a pipe at different locations about its periphery and adapted to grip and spin the pipe;

two body parts having first ends receivable at different sides respectively of said pipe and carrying said rollers, and having second ends opposite one another;

two nut structures movably mounting said body parts respectively;

two pivotal connections attaching said body parts at locations intermediate said first and second ends thereof to said nut structures respectively for pivotal movement of the body parts relative to the nut structures respectively about two spaced axes between a closed position in which said first ends of the body parts are moved toward one another so that the rollers grip and drive a pipe and said second ends are spaced apart, and an open position in which said first ends and rollers are spread apart to release the pipe and said second ends are closer together;

a manually rotatable adjusting screw having an external right hand thread and an axially aligned external left hand thread;

internal right hand and left hand threads in said two nut structures respectively engaging said right hand and left hand threads of said adjusting screw in a relation moving said nut structures and the axes of said pivotal connections toward and away from one another in response to rotation of said screw, to grip and drive different sizes of pipe;

bellows interposed between said second ends of said body parts and expansible by pressure fluid to urge said second ends of the body parts relatively apart and thereby swing said body parts about said pivotal axes relative to said nut structures and between open and closed positions in differently spaced conditions of said axes; and two motors carried by said body parts respectively and each operable to drive rollers carried by the corresponding body part in a relation turning the pipe in any of a plurality of different rotary settings of said adjusting screw in which said pivotal axes of the body parts are spaced different distances apart.

9. A pipe spinner as recited in claim 8, in which said bellows is essentially annular, and said second ends of the body parts form walls extending across and closing opposite ends of said bellows and sealed essentially annularly thereto.

10. A pipe spinner as recited in claim 9, including a handle for rotating said screw and connected to the screw for sliding movement axially relative thereto between an active position in which the handle projects laterally outwardly beyond one of said body parts and a retracted inactive position in which the handle does not project laterally outwardly beyond said part.

11. A pipe spinner as recited in claim 10, including slip clutches between said motors and the rollers driven thereby.

12. A pipe spinner as recited in claim 8, in which said screw has a splined portion projecting outwardly beyond said threads thereof and received within a recess in one of said body parts, there being a crank handle received about said splined portion of the screw and engageable therewith to rotate the screw and movable axially relative thereto along the splined portion of the screw between an outwardly projecting active turning position and a retracted position within said recess in said one body part.

13. A pipe spinner as recited in claim 12, including a spring disposed about said screw and yieldingly urging said crank handle axially inwardly relative thereto and into said recess.

14. A pipe spinner comprising:

a plurality of rollers engageable with a pipe at different locations about its periphery and adapted to grip and spin the pipe;

two body parts having portions receivable at different sides respectively of said pipe and each carrying at least one of said rollers;

two structures movably mounting said body parts respectively;

two pivotal connections attaching said body parts to said structures respectively for pivotal movement of the body parts relative to said structures about two spaced axes between a closed position in which the rollers grip and drive a pipe and an open position releasing the pipe;

a rotatable adjusting element having a right hand thread and a left hand thread;

right hand and left hand threads on said two structures respectively engaging said right hand and left hand threads of said adjusting element in a relation moving said structures and the axes of said pivotal connections toward and away from one another in response to rotation of said adjusting element, to grip and drive different sizes of pipe;

powered means for swinging said body parts about said pivotal axes relative to said structures and between open and closed positions in differently spaced conditions of said axes; and motor means operable to drive at least one of said rollers rotatively, and thereby turn the pipe, in any of a plurality of different rotary settings of said adjusting element in which said pivotal axes of the body parts are spaced different distances apart;

said powered means including a bellows interposed between two actuating portions of said body parts and operable by pressurized fluid to urge said actuating portions apart and thereby pivot said first mentioned portions of the two body parts and their carried rollers toward one another and against the pipe.

15. A pipe spinner comprising:

a plurality of rollers engageable with a pipe at different locations about its periphery and adapted to grip and spin the pipe;

two body parts having first ends receivable at different sides respectively of said pipe and carrying at least some of said rollers and having second ends opposite one another;

two structures movably mounting said body parts respectively;

two pivotal connections attaching said body parts at locations intermediate said first and second ends thereof to said two structures respectively for pivotal movement of the body parts relative to said structures respectively about two spaced axes between a closed position in which said first ends of the body parts are moved toward one another so that the rollers grip and drive a pipe and said second ends are spread apart, and an open position in which said first ends and rollers are spread apart to release the pipe and said second ends are closer together;

a rotatable adjusting element having a right hand thread and a left hand thread;

right hand and left hand threads on said two structures respectively engaging said right hand and left hand threads of said adjusting element in a relation moving said structures and the axes of said pivotal connections toward and away from one another in response to rotation of said adjusting element, to grip and drive different sizes of pipe;

powered means adapted to act against said second ends of the body parts and urge them relatively apart to swing said body parts about said pivotal axes relative to said structures and between open and closed positions in differently spaced conditions of said axes; and motor means operable to drive at least one of said rollers rotatively, and thereby turn the pipe, in any of a plurality of different rotary settings of said adjusting element in which said pivotal axes of the body parts are spaced different distances apart;

said powered means including a bellows interposed between said second ends of said body parts and operable by pressurized fluid to urge said second ends apart and thereby pivot said body parts about said axes to move their carried rollers toward one another and against the pipe.

* * * * *